United States Patent [19]

Honda

[11] Patent Number: 4,978,817

[45] Date of Patent: Dec. 18, 1990

[54] INTERLOCK SWITCH FOR A COPYING APPARATUS

[75] Inventor: Hiroyuki Honda, Hachioji, Japan

[73] Assignee: Konica Corporation, Tokyo, Japan

[21] Appl. No.: 388,846

[22] Filed: Aug. 3, 1989

[30] Foreign Application Priority Data

Aug. 12, 1988 [JP] Japan ..... 63-201667

[51] Int. Cl.[5] ..... H01H 9/20; G03G 15/04

[52] U.S. Cl. ..... 200/50 A

[58] Field of Search ..... 219/10.55 B, 10.55 C; 200/50 R, 50 A, 61.58 R, 61.62, 330, 335–338

[56] References Cited

U.S. PATENT DOCUMENTS

| | | | |
|---|---|---|---|
| 2,230,869 | 2/1941 | Neumann | 200/50 A |
| 4,201,901 | 5/1980 | Schuchert | 200/50 A X |
| 4,435,722 | 3/1984 | Kato | 200/61.62 |
| 4,461,940 | 7/1984 | Ishimura | 200/50 A X |

*Primary Examiner*—J. R. Scott

*Attorney, Agent, or Firm*—Finnegan, Henderson, Farabow, Garrett, and Dunner

[57] ABSTRACT

Disclosed is an interlock switch for switching on and off the power of a photo-copy machine, comprising a power switch, being adjacent to the rear panel of the photo-copy machine, for switching on and off the power of the photocopy machine; and an interlock for transmitting the open and closing operations of the front panel of the photo-copy machine to the power switch.

5 Claims, 2 Drawing Sheets

INTERLOCK SWITCH FOR A COPYING APPARATUS

BACKGROUND OF THE INVENTION

The present invention relates to a copier, and especially to a safety mechanism of a copier. Generally speaking, copiers are constructed with an outer casing which is made of light, inexpensive and hard plastic material. In this type of copier, in order to make the maintenance of the devices inside the copier easier, the photoconductor module, the developing module and the fixing module can be reached from the operator's side by opening the front door. Furthermore, in order to prevent an electric shock during maintenance service, an interlock switch is related to the front door movement. Therefore, electric power for the circuit of the copier is simultaneously shut off by opening the front door and is turned on again by closing the door.

In conventional copiers, the interlock switch is installed close to the front door, and connected with the main electronic controller which is placed at the rear frame side with a cable. The reason for this arrangement is that to install the interlock switch close to the front door and to install the main electronic controller close to the rear frame make the machine structure simple.

However, in the case where the length of the cable which connects the interlock switch with the electronic controller is long, some problems may be caused. That is to say, the cable tends to be damaged by heat and mechanical vibration in the copier, and in addition to that, the assembly work in the production becomes rather time consuming, and the long cable is apt to pick up an electrical noise which will cause a functional disorder in the controller.

To solve the problems mentioned above and to provide a copier in which the interlock switch can be operated in connection with the front door opening and closing movement without any wiring is the object of the present invention.

SUMMARY OF THE INVENTION

The object of the present invention is to provide an improved copier. In the copier of the invention, the interlock switch to control the electric power fed to the main electronic controller is installed at the rear frame side and a transmitting means which actuates the switch in accordance with the opening and closing movement of the front door is installed between the front and rear side of the copier. The opening and closing movement of the front door is transmitted to the interlock switch by a transmitting rod.

DETAILED DESCRIPTION OF THE INVENTION

Figure 1:
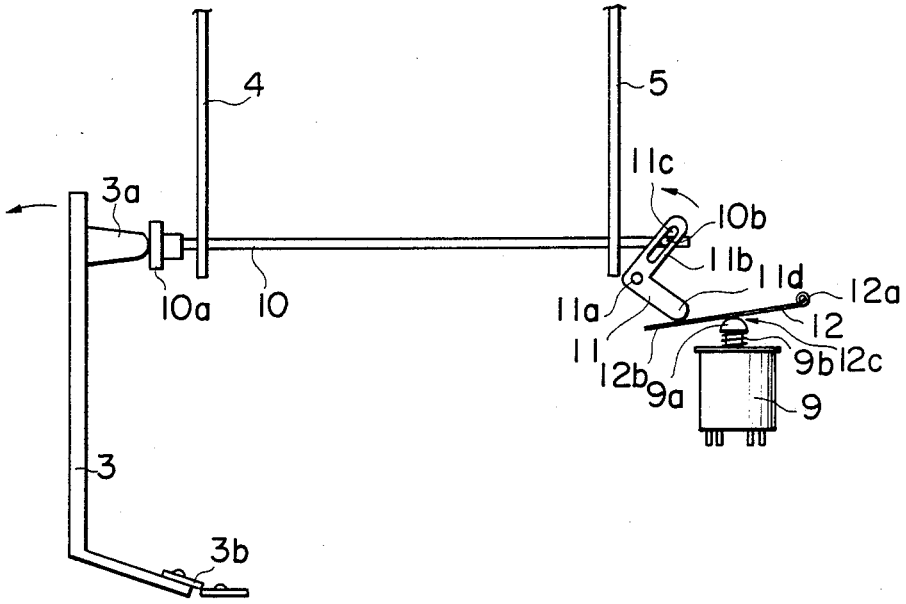
FIG. 1 is a sectional view which shows the location of front door, a transmitting rod and an interlock switch.
Figure 4:
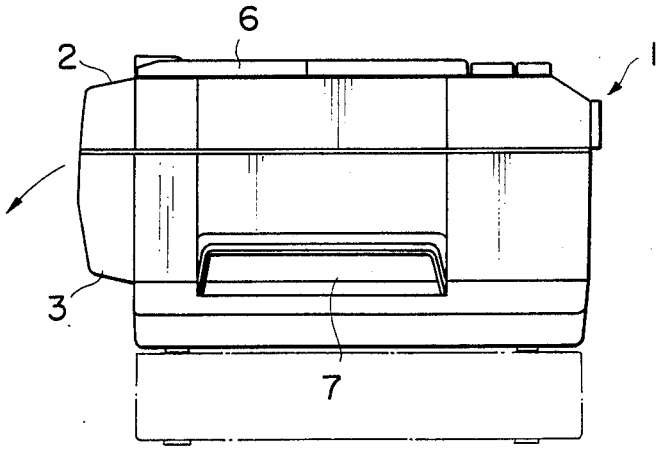
FIG. 4 is a side view of a copier of the invention.
Figure 2:
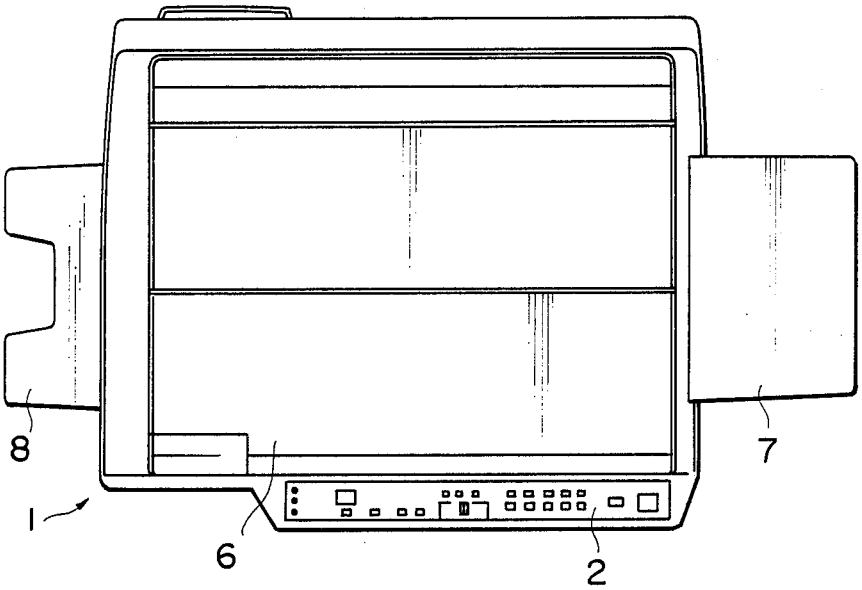
FIG. 2 is a top view of a copier of the invention.
Figure 3:
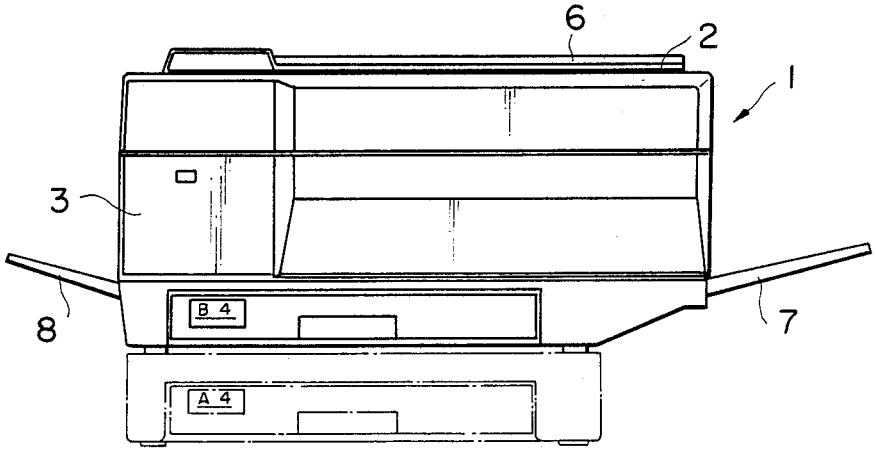
FIG. 3 is a front view of a copier of the invention.

Referring to the drawings showing an embodiment of the invention, the numeral 1 is a copier which has a box-shaped outer shell. An operator-control panel 2 and a front door 3 are equipped at the front side of the copier, in other words, operator's the side of the copier.

The above-mentioned front door 3 can be opened on the operator's side so as to facilitate the inspection of the inside of the copier when a service is needed and also when a copy paper jam takes place. The lower edge of the front door 3 is hinged at the bottom frame of the copier with a flexible holding member **3*b*** made of plastic so that the door can be opened on the operator's side.

At the upper part of the back surface of the front door 3, a protrusion **3*a* is equipped to push the transmitting rod 10. When the front door 3 is opened or closed the movement is transmitted to the rear side of the copier by pushing or releasing the transmitting rod 10 with the protrusion 3*a*. The numeral 4 is a front frame and the numeral 5 is a rear frame which form a part of copier body. Both frame 4 and 5 strengthen the copier structure along with the optical module, not shown, attached to them. The numeral 6 is a cover for holding an original document on a platen glass plate. The numeral 7 is a feeding tray from which copy paper is fed manually. The numeral 8 is a receiving tray on which copied papers are stacked. The numeral 9 is an interlock switch, which is installed close to the above-mentioned rear frame 5. The switch 9 is a press button type switch as shown in FIG. 1 which works by pressing the button 9*a*. As soon as the pressure to the button is released, the spring 9*b* stretches and turns off the electric power supply to the copier through the electronic controller. The numeral 10 is an example of the transmitting rod which is linked with the front door 3 and activates the interlock switch 9 in accordance with the opening or closing movement of the front door 3. The transmitting rod 10 is made of metal and installed through the front frame 4 and the rear frame 5 to move freely. When the front door 3 is opened, transmitting rod 10 moves forward by the action of the spring 9*b*, and when the door is closed, it is forced to move backwards. A cap 10*a* is mounted on the front end of the transmitting rod 10 and comes in contact with the protrusion 3*a* of the front door 3 when the front door is closed. A pin 10*b* is mounted on the rear end of the transmitting rod 10, and movably engages with the slotted hole 11*c* of the rotating member 11 which will be explained later. The pin can slide in the slotted hole 11*c* and turn the rotating member 11. The rotating member 11 is for converting the forward and backward motion of the transmitting rod 10 into a rotating motion, and/or for converting the rotating motion of the member 11 into the forward and backward motion of the rod 10. The rotating member 11 consists of an L-shaped member which is supported by the central axis 11*a*. The slotted hole 11*c* is in the central part of the portion 11*b* of the rotating member 11. At the same time, the other end 11*d* of the L-shaped member 11 will press or release the end part 12*b* of the actuator 12 according to the forward or backward movement of the transmitting rod 10 through the connecting action between pin 10*b* and the slotted hole 11*b*. In this case, the forward or backward movement of the rod 10 causes the opening or closing motion of the front door 3. The other end 12*a* of the actuator 12 is fixed, and the central portion 12*c* of the actuator 12 comes into contact with the button 9*a* of the interlock switch 9 so as to turn on or off the switch 9 according to whether the free end 12*b* of the actuator 12** is pressed or released.

When the front door 3 is closed, the protrusion **3*a* pushes the cap 10*a* of the transmitting rod 10 backward. So, the pin 10*b* in the slotted hole 11*c* rotates the L-shaped member 11. At this moment, the end part 11*d* of the L-shaped member 11 presses the free end 12***b* of the actuator 12. As a result, the central part 12*c* of the actuator 12 presses the button 9*a* to activate the interlock switch 9 and the power supply for the circuit in the copier is turned on. As the front door is opened, the button 9*a* of the interlock switch 9 is stretched by the spring 9*b*. By this action, the button 9*a* pushes up the actuator 12 and the power supply for the copier is turned off. Accordingly, the rotating member 11 rotates in the opposite direction so that the door is closed, and moves the pin 10*b* in the slotted hole 11*a* to push the transmitting rod 10 forward. The transmitting rod 10 moves forward a fixed length and stops. In this way, the opening and closing movement of the front door 3 is transferred by the metal transmitting rod 10 to the rear portion of the copier. Therefore, the problems caused by use of a cable vibration of the machine, heat in the machine and the electrical noise can be solved.

An example of the present invention is explained above. The transmitting means to activate the interlock switch 9 in connection with the opening and closing movement of the front door 3 can be a link mechanism in which a plate shaped member is used instead of the transmitting rod, wherein the plate shaped member functions in the same way as the rod. The transmitting means can also be such that the L-shaped member is driven by a piano wire or so from the front door side.

The feature of the present invention is that the interlock switch to control the power supply for the main electronic controller is installed at the rear side of the copier, and the transmitting means to operate the interlock switch in connection with the opening and closing motion of the front door is provided through the front and the rear frames to link the front door and the interlock switch without any wiring.

Furthermore, the efficiency in the production of the copier has been greatly improved and in accordance with that the assembly of the copier became easier. As a result, safety in the copier operation was greatly increased, and also the reliability of the copier could be improved.

What is claimed is:

1. An interlock switching apparatus for switching a copying apparatus power supply on and off, the copying apparatus including a front and a rear panel and a front and a rear frame, wherein the front panel is capable of being selectively moved between an opened position and a closed position, the switching apparatus comprising:

switch means disposed in proximity to the rear panel for switching the copying apparatus on and off;

interlock means movably disposed in the front and rear frames for identifying the opened and closed positions of the front panel to the switch means, the interlock means including first and second opposed ends;

a rotatable member rotatably disposed on the first opposed end of the interlock means; and actuating means in communication with the rotatable member for moving the interlock means towards the rear panel when the front panel is closed, rotating the rotatable member to press the actuating means and activating the switch means, and returning the interlock means towards the front panel, rotating the rotatable member in an opposite direction, releasing the actuating means by the rotatable member and deactivating the switch means when the front panel is opened.

2. The switching apparatus of claim 1 further comprising a protrusion on an interior surface of the front panel.

3. The switching apparatus of claim 2 further comprising a cap on the second opposed end of the interlock means, the protrusion on the front panel contacting the cap to move the interlock means.

4. The switching apparatus of claim 1 wherein the rotatable member comprises an L-shaped member.

5. The switching apparatus of claim 1 wherein the interlock means comprises an elongated, metal member.

* * * * *